US008306466B2

(12) United States Patent
Creteau et al.

(10) Patent No.: US 8,306,466 B2
(45) Date of Patent: Nov. 6, 2012

(54) LUBRICANT RETENTION FEATURES ON HEATER BODY OF A FUSER

(75) Inventors: Gregory Daniel Creteau, Winchester, KY (US); Jerry Wayne Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 334 days.

(21) Appl. No.: 12/632,475

(22) Filed: Dec. 7, 2009

(65) Prior Publication Data

US 2011/0135353 A1 Jun. 9, 2011

(51) Int. Cl.
*G03G 15/20* (2006.01)

(52) U.S. Cl. ..... 399/329; 399/122; 399/320

(58) Field of Classification Search ..... 399/122, 399/320, 329

See application file for complete search history.

(56) References Cited

U.S. PATENT DOCUMENTS

| | | | | |
|---|---|---|---|---|
| 1,563,704 | A | 12/1925 | Greis | |
| 2,717,037 | A | 9/1955 | Goodwillie | |
| 4,566,162 | A | 1/1986 | Brands | |
| 4,773,143 | A | 9/1988 | Okamura et al. | |
| 5,016,530 | A | 5/1991 | Palmatier | |
| 5,222,434 | A | 6/1993 | Smith et al. | |
| 5,528,338 | A | 6/1996 | Kobayashi et al. | |
| 6,250,220 | B1 | 6/2001 | Sainio et al. | |
| 6,735,412 | B2 | 5/2004 | Berg et al. | |
| 7,805,102 | B2 | 9/2010 | Kato | |
| 2003/0103788 | A1 | 6/2003 | Yura et al. | |
| 2005/0220510 | A1 * | 10/2005 | Tsunoda | 399/329 |
| 2007/0071517 | A1 | 3/2007 | Blair et al. | |
| 2008/0298862 | A1 * | 12/2008 | Shinshi | 399/324 |

FOREIGN PATENT DOCUMENTS

| | | |
|---|---|---|
| JP | 09-101695 | 4/1997 |
| JP | 10-198200 | 7/1998 |
| JP | 2000-039787 | 2/2000 |
| JP | 2003-076178 | 3/2003 |
| JP | 2005-091557 | 4/2005 |
| JP | 2006-330530 | 12/2006 |
| JP | 2008-026603 | 2/2008 |

* cited by examiner

*Primary Examiner* — Ryan Walsh

(57) ABSTRACT

A fuser assembly including a heater assembly that includes a heater body, the heater body includes a substrate that extends across the fuser nip. A plurality of retention features are defined on a protective layer covering the surface of the substrate. The protective layer includes a first layer and a second layer, the second layer including a plurality of passages extending from an outer surface of the second layer to the first layer and dimensioned and positioned to allow a lubricant to pass through the second layer between the retention features and the outer surface of the second layer.

22 Claims, 9 Drawing Sheets

LUBRICANT RETENTION FEATURES ON HEATER BODY OF A FUSER

BACKGROUND

1. Field of the Invention

The present invention relates generally to electrophotographic imaging device and particularly to a fuser assembly having a plurality of lubricant retention features defined on a heater body of the fuser assembly and dimensioned to retain the lubricant on the interior surface of a fuser belt adjacent a fuser nip.

2. Description of the Related Art

An electrophotographic imaging device, such as a laser printer, forms a latent electrostatic image on a surface of a photoconductor by selectively exposing an area of the surface to light. The latent electrostatic image is developed into a visible image by electrostatic toners that contain pigment components and thermoplastic components. A print media (e.g., a sheet of paper or a transparent sheet) is given an electrostatic charge opposite to that of the toner and then passed close to a surface of the photoconductor, pulling the toner from the photoconductor onto the sheet of paper or transparent sheet in the pattern of the image developed from the photoconductor. After the image is transferred to the print media, the print media is processed through a fuser assembly where it is heated and pressed. The fuser assembly melts and fixes the toner to the print medium surface, thereby producing a substantially permanent printed image. The fuser belt is rotated by a backup roller that is pressed against the fuser belt to form a nip. A ceramic heater is positioned in the interior surface of the fuser belt. As the fuser belt is rotated, an interior surface of the fuser belt slides on the heater surface. The sliding contact between the fuser belt and the heater surface can cause a high frictional force that is undesirable.

To reduce this frictional force, grease and oil have been commonly used as lubricants between the belt and the heater. Greases normally have higher viscosity than oil and can form thicker films on the fuser belt and heater surface. Higher viscosity can cause higher frictional force and driving torque, and thicker film thickness can increase thermal resistance and lower toner fusing capability. As the grease/oil leaves the fuser nip, the lubricant condition between the fuser belt and the heater worsens, leading to higher driving torque, higher fuser belt wear, and sometimes damaging the fuser belt.

Therefore, it would be desirable to maintain grease/oil in the fuser nip and keep the lubrication condition between the fuser belt and the heater at acceptable levels.

SUMMARY OF THE INVENTION

Embodiments of the present invention overcome shortcomings of prior fuser assembly and thereby satisfy a significant need for maintaining lubricant in the heater body. According to an exemplary embodiment of the present invention, there is provided an image forming apparatus for fixing a toner image on a print media, including a media feed section for feeding said print media along a media feed path in a media feed direction and a fuser assembly. The fuser assembly includes a backup roller, a fuser belt defining an interior space and having an exterior surface and an interior surface, the exterior surface of the belt contacting the backup roller to form a fuser nip. A heater assembly is located in the interior space of the fuser belt, the heater assembly including a heater body positioned to contact the interior surface of the fuser belt and having a plurality of retention features defined on the heater body and dimensioned to retain a lubricant on the interior surface of the fuser belt adjacent the fuser nip.

In some embodiments, the retention features include edges that are substantially perpendicular to the media feed direction.

In yet another embodiment, the heater body includes a substrate that extends across the fuser nip, at least one heating element disposed on a surface of the substrate for generating heat, and at least one protective layer covering the surface and the at least one heating element, the retention features being defined in the at least one protective layer.

In yet another embodiment, the at least one protective layer includes a first layer in which the retention members are defined, and a second layer covering the first layer, the second layer including a plurality of passages extending from an outer surface of the second layer to the first layer and dimensioned and positioned for allowing the lubricant to pass through the second layer between the retention features and the outer surface of the second layer, the outer surface of the second layer contacting the interior surface of the fuser belt.

In yet another embodiment of the invention, a fuser assembly is configured to fix a toner image to a print media moving in a media feed direction through a nip. The fuser assembly includes a backup roller, a fuser belt defining a belt moving direction at the nip corresponding to the media feed direction, and a heater assembly including a heater body. The heater body is positioned to contact an interior surface of the fuser belt and includes a plurality of lubricant retention features on the heater body to retain a lubricant.

In some embodiments, each lubricant retention feature has a width and a length, the width and length of each lubricant retention feature is less than or equal to about 500 microns.

In yet another embodiment of the invention, an image forming apparatus is configured for fixing a toner image on a print media, including a media feed section for feeding the print media along a media feed path in a media feed direction, and a fuser assembly. The fuser assembly includes a backup roller; a fuser belt defining an interior space and has an exterior surface and an interior surface, the exterior surface of the fuser belt contacts the backup roller to form a fuser nip; and a heater assembly located in the interior space of the fuser belt, the heater assembly including a heater body positioned to contact the interior surface of the fuser belt, a plurality of retention features on the heater body to retain a lubricant, and a glass layer covering a portion of the heater body and having feed through holes formed therein, the feed through holes forming path to move the lubricant in and out of the heater body.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein:

FIG. 8 is an expanded view of a retention feature covered by the second layer having a typical passage extending from the outer surface and positioned to allow the lubricant to pass through.

DETAILED DESCRIPTION

Figure 1:
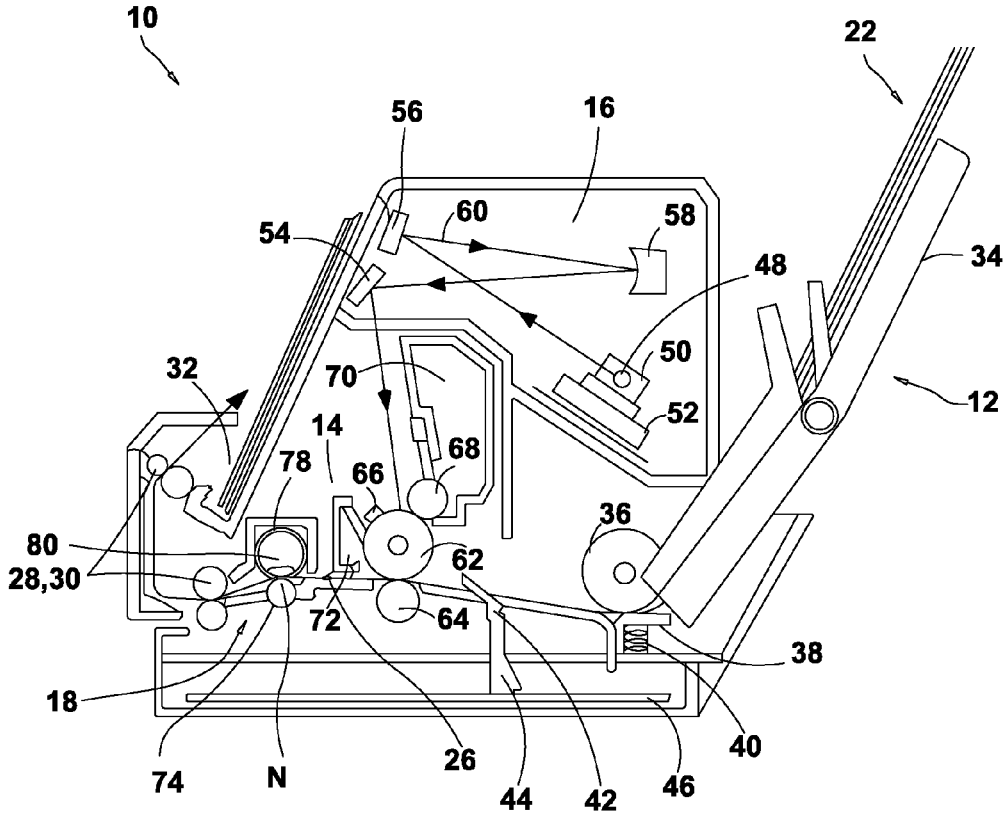
FIG. 1 is a side elevational view of one embodiment of an image forming apparatus according to an exemplary embodiment of the present invention.

It is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof are used broadly and encompass direct and indirect connections, couplings and mountings. In addition, the terms "connected" and "coupled" and variations thereof are not restricted to physical or mechanical connections or couplings.

Reference will now be made in detail to the exemplary embodiment(s) of the invention as illustrated in the accompanying drawings. Whenever possible, the same reference numerals will be used throughout the drawings to refer to the same or like parts.

FIG. 1 is an image forming apparatus 10, e.g., a laser printer and/or copier, configured in accordance with an embodiment of the present invention. The image forming apparatus 10 includes a media feed section 12, an image-forming device 14, a laser scanning device 16, and a fuser assembly 18.

Media feed section 12 may include rollers, a media pick mechanism and other components which sequentially transport a sheet of print media (e.g., a paper) 22 along a media feed path from media input tray 34 to the image forming device 14 and then to media output tray 32. The image-forming device 14 transfers a toner image to the transported sheet of print media 22. Fuser assembly 18 fixes the transferred toner image to the print media 22. Thereafter, the print media 22 is ejected out of the image forming apparatus 10 by media transport rollers 28, 30 and into output tray 32.

In the exemplary image forming apparatus 10, the media feed section 12 may include media input tray 34, a media feed roller 36, a media separating friction plate 38, a pressure spring 40, a media detection actuator 42, a media detection sensor 44, and a control circuit 46. Upon receiving a print instruction, the print media 22 which have been placed in media feed tray 34 are fed one-by-one by operation of media feed roller 36, media separating friction plate 38 and pressure spring 40. As the print media 22 pushes down or otherwise engages with media detection actuator 42, media detection sensor 44 outputs an electrical signal instructing commencement of printing of the image. It is understood that media feed section 12 may include other mechanisms for picking a sheet of print media 22 from a stack and detecting its position along the media feed path for synchronizing image transfer.

Laser scanning device 16 includes laser diode light-emitting unit 48, a scanning mirror 50, a scanning mirror motor 52, and reflecting mirrors 54, 56, and 58. The scanning mirror 50 is rotated at a constant high speed by the scanning mirror motor 52 such that a laser light beam 60 scans in a vertical direction to the print media surface. The laser light beam 60 radiated by laser diode light-emitting unit 48 is reflected by reflecting mirrors 54, 56, and 58 so as to be incident onto a photosensitive body 62 of image-forming device 14.

In addition to the photosensitive body 62, image-forming device 14 includes a transfer roller 64, a charging member 66, a developing roller 68, a developing unit 70, and a cleaning unit 72. The surface charge of photosensitive body 62, charged in advance by charging member 66, is selectively discharged by the laser light beam 60. An electrostatic latent image is thus formed on the surface of the photosensitive body 62. The electrostatic latent image is visualized by developing roller 68 and developing unit 70. Specifically, the toner supplied from developing unit 70 is adhered to the electrostatic latent image on photosensitive body 62 by developing roller 68 as to form the toner image.

The print media 22 transported from media input tray 34 is transported downstream while being transported through photosensitive body 62 and transfer roller 64. The print media 22 arrives at the transfer nip in timed coordination with the toned image on the photosensitive body 62. As the print media 22 is transported downstream, the toner image formed on the photosensitive body 62 is electrically attracted and transferred to the print media 22 by an interaction with the electrostatic field generated by transfer voltage applied to transfer roller 64. Any toner that still remains on photosensitive body 62, not having been transferred to print media 22, is collected by cleaning unit 72. Thereafter, the print media 22 is transported to fuser assembly 18. The fuser assembly 18 includes a backup roller 74, a fuser belt 78, and a heater assembly 80.

Figure 2:
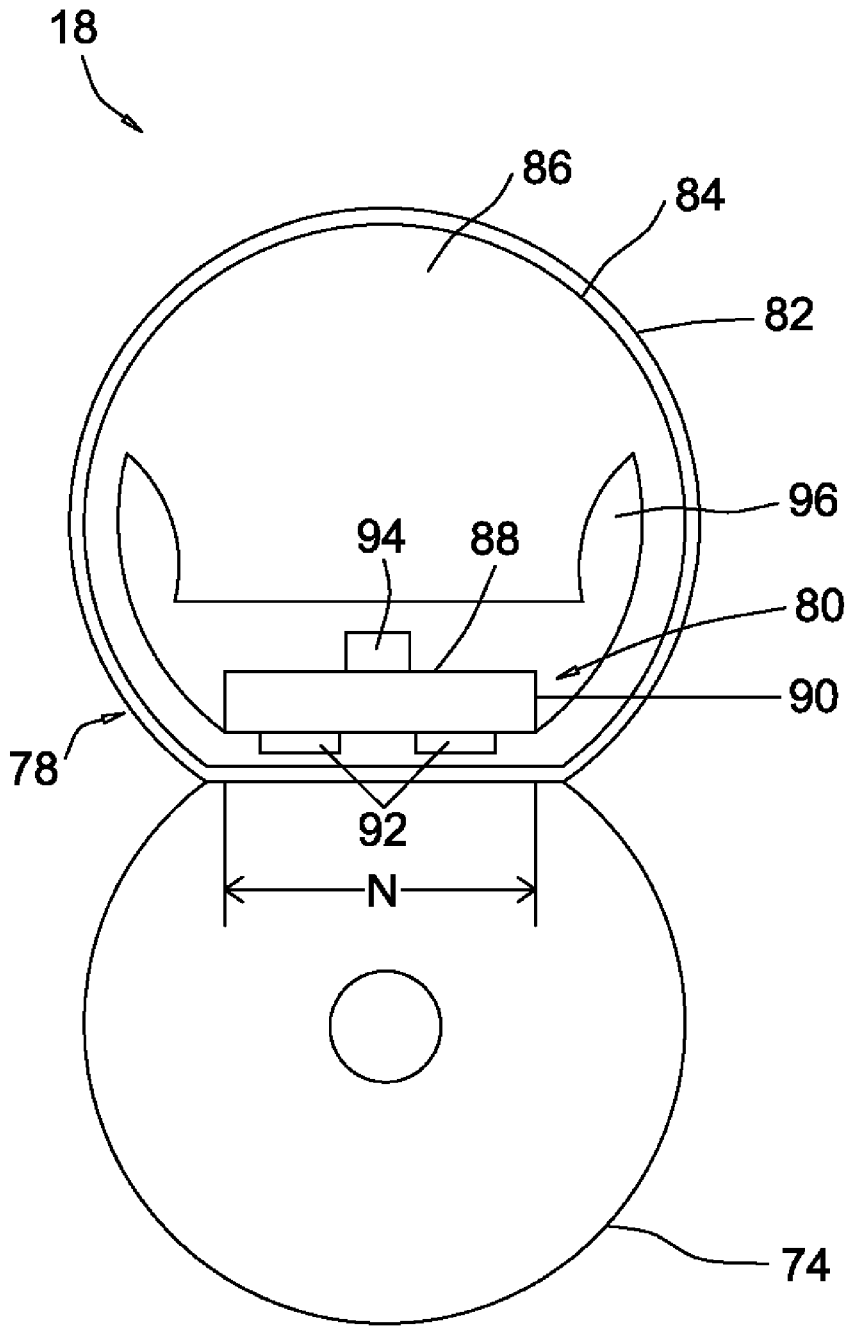
FIG. 2 is a side view of a fuser assembly of the image forming apparatus of FIG. 1.

Referring to FIG. 2, the backup roller 74 of the fuser assembly 18 is generally cylindrical in shape. The backup roller 74 is made from, or is coated with, a material that has good release and transport properties for the print media 22. The backup roller 74 may be sufficiently soft so as to allow it to be rotated against the fuser belt 78 to form a fuser nip N through which the print media 22 travels. The backup roller 74 may be formed, for example, from silicone rubber. As the print media 22 passes through the fuser nip N, the print media 22 is placed under pressure, and due to this pressure, for whatever time the sheet is in fuser nip N, the heat from the fuser belt 78 acts to fix the toner to print media 22.

The fuser belt 78 is an endless belt having an exterior surface 82, an interior surface 84, and a hollow interior space 86. The fuser belt 78 is formed from a highly resistive and durable material having good parting properties and may have a thickness of about 75 microns or less. The fuser belt 78 may be formed, for example, from a polymide film or metal sleeve. The fuser belt 78 may have an outer coating of, for example, a fluororesin and/or Teflon® material to optimize release properties of the fixed toner. The fuser belt 78 may be shaped, for example, as a tube.

The heater assembly 80 applies pressure on the fuser belt 78 while the print media 22 moves through the fuser nip N formed by backup roller 74 and the fuser belt 78. The thermoplastic components of the toner on the print media 22 are melted by heat supplied from heater assembly 80, through fuser belt 78 and fixed to the print media 22 to form the fixed image. The print media 22 is then transported and ejected out of image forming apparatus 10 by media transport rollers 28, 30 and into the output tray 32 (FIG. 1).

As illustrated in FIG. 2, the heater assembly 80 is located in the hollow interior space 86 of fuser belt 78. The heater assembly 80 includes a heater body 88 including a substrate 90 that extends across the fuser nip N. The heater body 88 further includes at least one heating element 92 disposed on the surface of the substrate 90 for generating heat. The substrate 90 is typically made of ceramic, extending in a direction substantially perpendicular to the direction of movement of the fuser belt 78.

The substrate 90 of heater body 88 is electrically insulative, has a high thermal conductivity, and has high heat resistance, as well as low thermal capacity. One or more heating elements 92 in a line or stripe extend along the length of the heater body 88 on the lower surface of the substrate 90, and a temperature detecting element 94, for example, a thermistor, is mounted in contact with the upper surface of the heater body 88. A thermal cut-off (TCO) device (not shown) may also be placed in contact with the upper surface of heater body 88 for the purpose of opening the circuit in the unlikely event of a thermal runaway condition. The thermal capacity (heat retention) of the heater assembly 80, as a whole, is low. The heater body 88 is positioned to contact the interior surface 84 of the fuser belt 78. A lubricant provides lubrication between interior surface 84 of fuser belt 78 and heater body 88. The heater assembly 80 is fixed to a holder 96 with the bottom face of the heater body 88 facing the nip N that receives print media 22.

Figure 3:
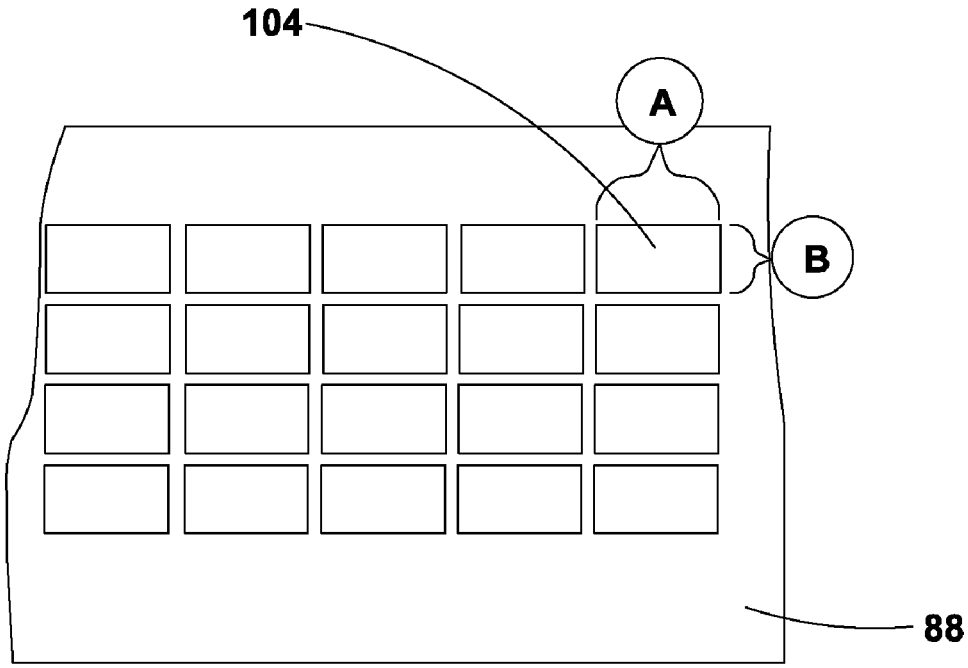
FIG. 3 is a top view of a portion of heater body of the image forming apparatus of FIG. 1 showing a plurality of retention features defined on a first layer of a protective layer of the heater body according to an exemplary embodiment of the present invention.

In accordance with the present invention and as shown in FIG. 3, a plurality of retention features 104 are defined on the heater body 88 to retain a lubricant in the heater body 88, and oriented to reduce the possibility of the lubricant in the fuser assembly 18 from leaking out, so as to maintain an effective lubrication condition between the fuser belt 78 and the body 88 (FIG. 2). The retention features 104 are patterned having a substantially rectangular or parallelogram shaped pattern. However, those skilled in the art will recognize that other shapes, such as a curved shape, may be used in forming the retention features 104. In this embodiment, the retention features 104 have a length A and a width B such that the width B and the length A of the retention features 104 are each less than or equal to about 500 microns. The distance between each retention feature 104 is less than about 0.5 mm and between about 0.03 and about 0.05 mm. The retention features 104 may have a thickness and/or height of about 1.27 mm. The retention features 104, apart from keeping the lubrication condition between the fuser belt 78 and the heater body 88 in a good condition, also ensure lower driving torque, lower belt wear and maintain a higher fusing grade so that the life of the fuser assembly 18 can be increased.

Figure 4:
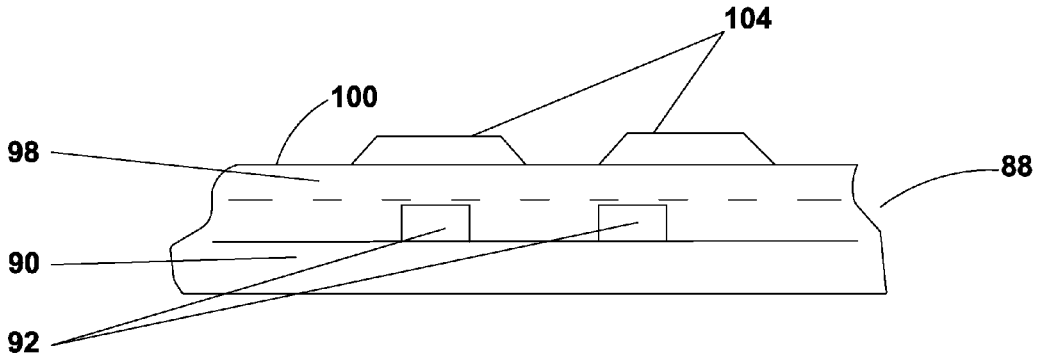
FIG. 4 is a side view of a typical pattern of the retention features defined on the first layer of the heater body according to an exemplary embodiment of the present invention.

FIG. 4 illustrates a partial cross sectional view of heater body 88 of FIG. 3. Heating elements 92 are formed on substrate 90. At least one protective layer 98 is disposed over and covers heating elements 92 and the surface of the substrate 90. The retention features 104 may be formed on the outer surface of protective layer 98 using substantially the same composition thereof. The retention features 104 on the protective layer 98 may be defined by printing a glass pattern via a thick film printing process used to create a ceramic heater. This process may include a thick film printing such as two laminated 96% aluminum oxide layers yielding a total thickness (height) of about 1.27 mm. The heating elements 92 may be printed or otherwise defined in separate print, oven dry, and furnace fire sequences, followed by subsequent print, oven dry, and furnace fire sequences to define the protective layer 98. The outermost protective layer is then applied so as to form the rectangular or parallelogram shaped retention features 104'.

Figure 5:
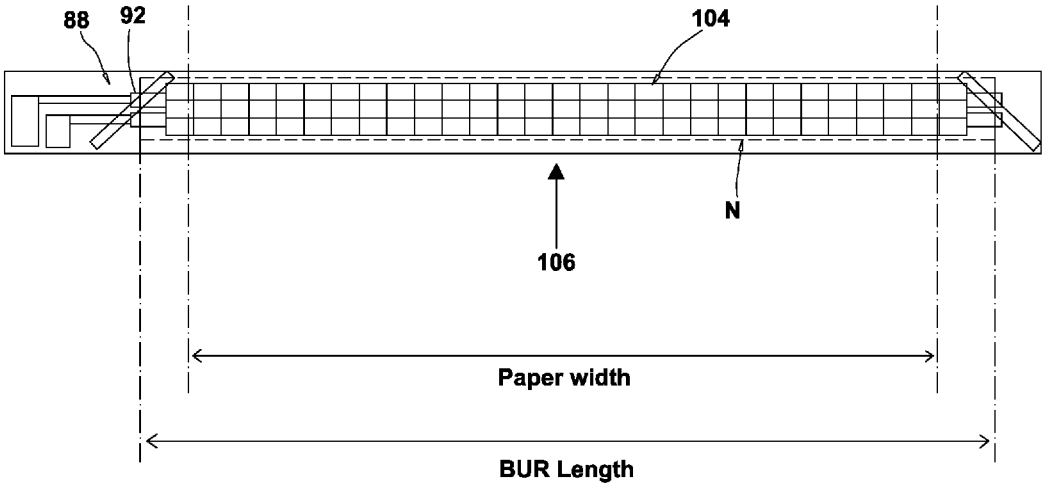
FIG. 5 is a top view showing a plurality of rectangular shaped retention features on the heater body according to another exemplary embodiment of the present invention.
Figure 6:
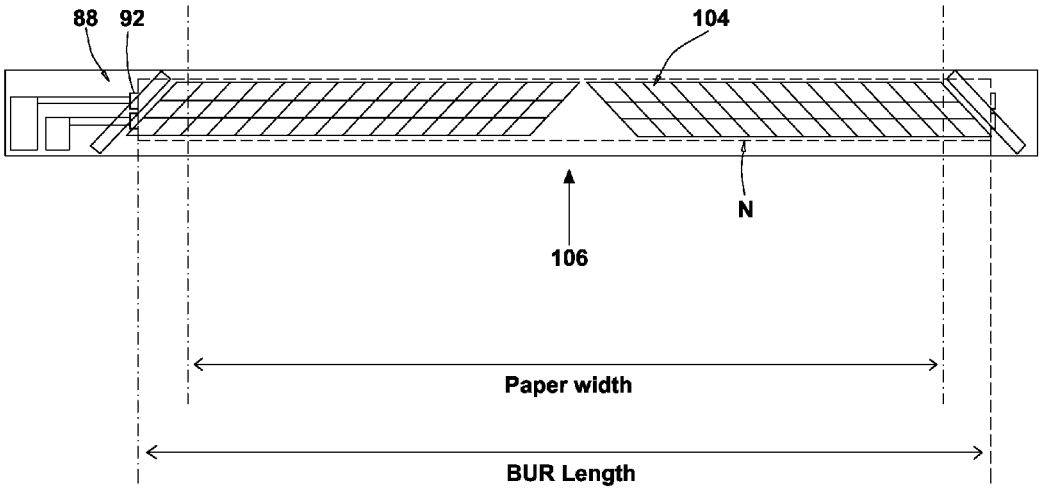
FIG. 6 is a top view of another embodiment of a heater body showing a plurality of parallelogram shaped retention features on the heater body.

FIGS. 5 and 6 illustrate heater body 88 according to an embodiment of the present invention, showing the retention features 104 arranged in a rectangular pattern and in a parallelogram pattern, respectively, along the length of the heater body 88. The retention features 104 may be oriented substantially perpendicular to the direction of movement 106 of fuser belt 78 and/or print media 22. The center of the retention features 104 may be located at about the center of the fuser nip N-).

Figure 7:
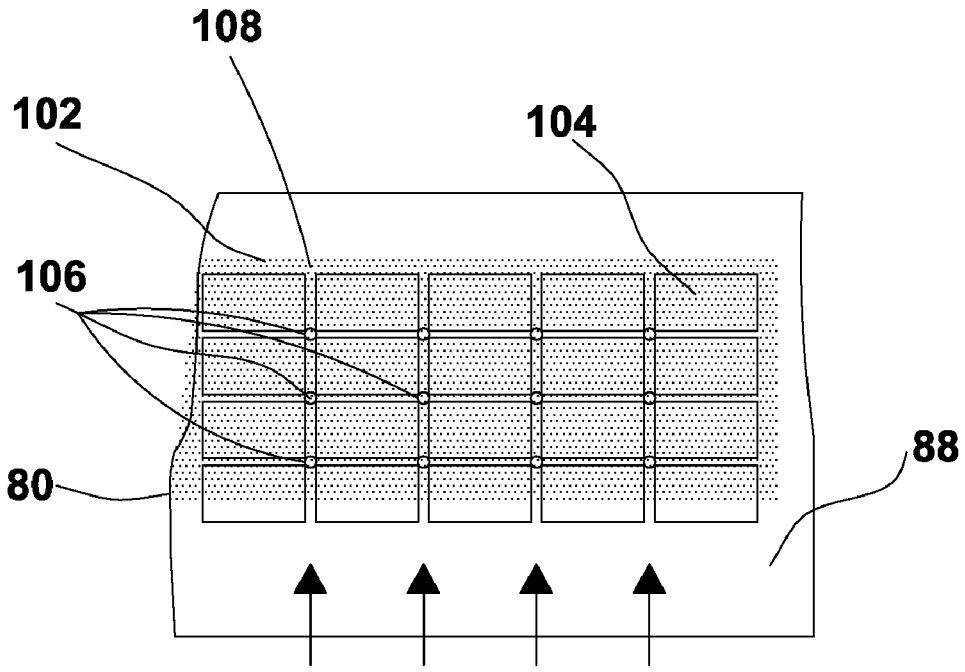
FIG. 7 is a top view of a portion of the heater body showing the plurality of retention features and a second layer having plurality of passages extending from an outer surface of the second layer positioned to allow the lubricant.
Figure 8:
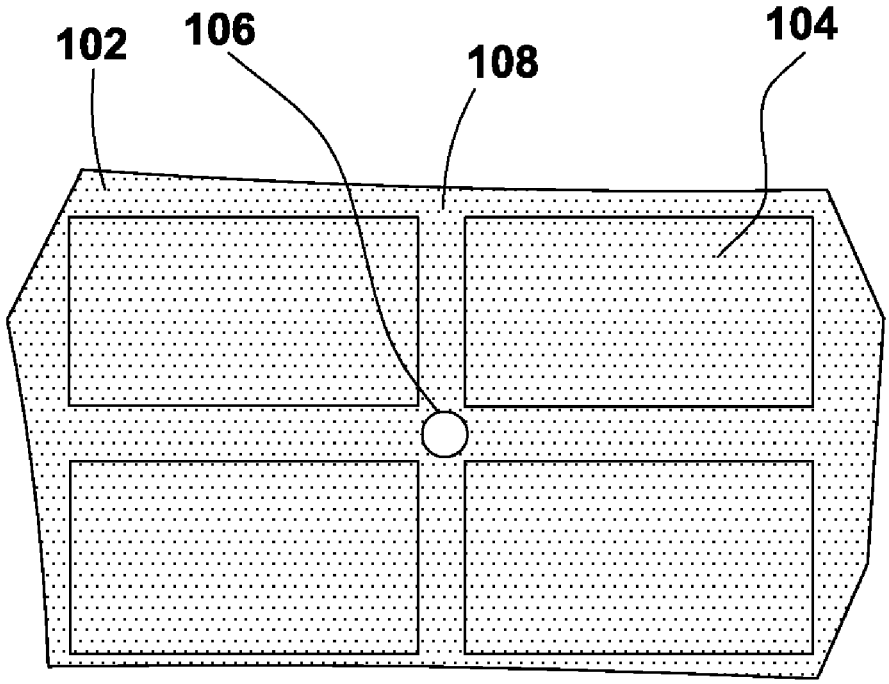
Figure 9:
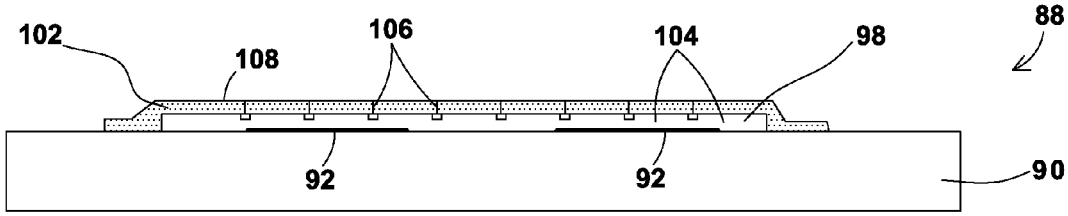
FIG. 9 is a side view of the heater body showing the protective layer with the first layer and the second layer and plurality of passages extending from the outer surface of the second layer.

FIGS. 7-9 illustrate heater body 88 according to another exemplary embodiment of the present invention. In this embodiment, a second protective layer 102 covers retention features 104. The second layer 102 includes a plurality of passages 106 extending from an outer surface 108 of the second layer 102 to an inner surface thereof and positioned for allowing the lubricant to pass through the second layer 102 between the retention features 104 and the outer surface 108 of the second layer 102. The lubricant is applied through the outer surface of the second layer 102 prior to assembling the fuser assembly 18 in the direction shown by arrow signs in FIG. 7.

FIG. 8 illustrates an expanded view of the retention features 104 and a typical passage 106 formed in second layer 102. A passage 106 may be disposed at the corner of four adjacent retention features 104, as shown. FIG. 9 illustrates a side view of the heater body 88 of FIG. 7 showing the plurality of passages 106 extending from the outer surface 108 of the second layer 102 to protective layer 98 between the retention features 104.

In utilizing the above embodiments, the heating and cooling cycles of the fuser assembly 18 can then be used as a means to subsequently empty and fill the underlying reservoirs with lubricant via capillary action. The embodiments substantially prevent an excessive amount of lubricant from being lost by wicking around the substrate 90 of the heater body 88.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A fuser assembly, the fuser assembly comprising:

a backup roller;

a fuser belt defining an interior space and having an exterior surface and an interior surface, the exterior surface of the fuser belt contacting the backup roller to form a fuser nip;

a heater assembly located in the interior space of the fuser belt, the heater assembly including a heater body, the heater body being positioned to contact the interior surface of the fuser belt; and wherein the heater body includes a plurality of retention features formed on or within the heater body, the plurality of retention features dimensioned to retain a lubricant on the interior surface of the fuser belt adjacent the fuser nip, wherein the heater body further comprises a substrate that extends across the fuser nip, at least one heating element disposed on a surface of the substrate for generating heat for a fusing operation, and at least one protective layer covering the surface of the substrate and the at least one heating element, the retention features being defined on or within the at least one protective layer.

2. The fuser assembly of claim 1, wherein the retention features include edges that are substantially perpendicular to a media feed direction through the fuser assembly.

3. The fuser assembly of claim 1, wherein the retention features have a substantially rectangular pattern.

4. The fuser assembly of claim 1, wherein the retention features have a substantially parallelogram shaped pattern.

5. The fuser assembly of claim 1, wherein a distance between each retention feature is less than about 0.5 mm.

6. The fuser assembly of claim 1, wherein each retention feature has a width and a length, the width and the length of each retention feature are less than or equal to about 500 microns.

7. The fuser assembly of claim 6, wherein the retention features are patterned across at least a portion of the heater body.

8. The fuser assembly of claim 1, wherein the retention features extend across the area defining the fuser nip.

9. The fuser assembly of claim 1, wherein the retention features comprise a glass composition.

10. A fuser assembly, comprising:

a backup roller;

a fuser belt defining an interior space and having an exterior surface and an interior surface, the exterior surface of the fuser belt contacting the backup roller to form a fuser nip;

a heater assembly located in the interior space of the fuser belt, the heater assembly including a heater body, the heater body being positioned to contact the interior surface of the fuser belt;

wherein the heater body includes a plurality of retention features defined on the heater body and dimensioned to retain a lubricant on the interior surface of the fuser belt adjacent the fuser nip;

wherein the heater body comprises a substrate that extends across the fuser nip, at least one heating element disposed on a surface of the substrate for generating heat, and at least one protective layer covering the surface of the substrate and the at least one heating element, the retention features being defined by the at least one protective layer; and wherein the at least one protective layer comprises a first layer in which the retention members are defined, and a second layer covering the first layer, the second layer including a plurality of passages extending from an outer surface of the second layer to the first layer and dimensioned and positioned for allowing the lubricant to pass through the second layer between the retention features and the outer surface of the second layer, the outer surface of the second layer contacting the interior surface of the fuser belt.

11. A fuser assembly configured to fix a toner image to a print media moving in a media feed direction through a nip, said fuser assembly comprising:

a backup roller;

a fuser belt defining a belt moving direction at said nip corresponding to said media feed direction;

a heater assembly including a heater body, the heater body positioned to contact an interior surface of the fuser belt adjacent the nip;

wherein the heater body includes a substrate, at least one heating element disposed on a surface of the substrate for generating heat for a fusing operation, and at least one protective layer covering the surface of the substrate and the at least one heating element, the at least one protective layer including a plurality of lubricant retention features formed between the at least one heating element and an outer surface of the heater body contacting the interior surface of the fuser belt, the lubricant retention features being dimensioned to retain a lubricant.

12. The fuser assembly of claim 11, wherein the lubricant retention features include edges that are substantially perpendicular to the belt moving direction of the fuser belt.

13. The fuser assembly of claim 11, wherein the lubricant retention features have a substantially rectangular pattern.

14. The fuser assembly of claim 11, wherein the lubricant retention features have a substantially parallelogram shaped pattern.

15. The fuser assembly of claim 11, wherein distance between each lubricant retention feature is less than about 0.5 mm.

16. The fuser assembly of claim 11, wherein a center of the lubricant retention features is located at about a center of the nip.

17. The fuser assembly of claim 11, wherein each lubricant retention feature has a width and a length, the width and length of each lubricant retention feature are less than or equal to about 500 microns.

18. The fuser assembly of claim 17, wherein the lubricant retention features are patterned across at least a portion of the heater body.

19. The fuser assembly of claim 17, wherein the lubricant retention features are patterned across an entire length of the substrate.

20. A heater assembly for a toner fusing device, comprising:

a heater body having a substrate, at least one heating element disposed on the substrate for generating heat for a fusing operation and at least one protective layer covering the at least one heating element and the surface of the substrate, the at least one protective layer defining retention features to retain lubricant and feed through passages extending from an outer surface of the heater body to the retention features for moving the lubricant in and out of the retention features.

21. The heater assembly of claim 20, wherein gaps between adjacent retention features are dimensioned for retaining the lubricant, and the feed through passages define passages for lubricant flow between the outer surface of the heater body and the gaps.

22. The heater assembly of claim 21, wherein the gaps are arranged in intersecting rows and columns, and each feed through passage provides fluid communication to an intersection of a row and a column.

* * * * *